US005279334A

United States Patent [19]

Takegawa

[11] Patent Number: 5,279,334

[45] Date of Patent: Jan. 18, 1994

[54] REED MAINTENANCE DEVICE WITH WARP SHEET REPOSITIONER

[75] Inventor: Yujiro Takegawa, Ishikawa, Japan

[73] Assignee: Tsudakoma Kogyo Kabushiki Kaisha, Ishikawa, Japan

[21] Appl. No.: 910,500

[22] Filed: Jul. 8, 1992

[30] Foreign Application Priority Data

Jul. 10, 1991 [JP] Japan ..... 3-264276

[51] Int. Cl.[5] ..... D03J 1/00

[52] U.S. Cl. ..... 139/1 C; 139/192

[58] Field of Search ..... 139/1 C, 351, 192, 353, 139/11, 457–459, 48–50, 116.2

[56] References Cited

U.S. PATENT DOCUMENTS 4,606,152 8/1986 Michihara et al. ..... 139/1 C X
4,640,316 2/1987 Wakai ..... 139/1 C
4,815,498 3/1989 Gryson et al. ..... 139/351
5,046,535 9/1991 Prat ..... 139/351
5,111,851 5/1992 Takegawa ..... 139/192 X

FOREIGN PATENT DOCUMENTS 61-32416 7/1986 Japan .
61-56340 12/1986 Japan .

*Primary Examiner*—Andrew M. Falik
*Attorney, Agent, or Firm*—Wenderoth, Lind & Ponack

[57] ABSTRACT

In a shuttleless loom, a warp sheet is moved from a space that is necessary for maintenance and inspection of a reed. An arranging bar is provided over the warp sheet between a shedding frame and a cloth fell so as to be vertically movable. When the arranging bar is lowered at the time of maintenance and inspection of the reed, the warp sheet can be moved to the lower side of the reed.

13 Claims, 4 Drawing Sheets

REED MAINTENANCE DEVICE WITH WARP SHEET REPOSITIONER

BACKGROUND OF THE INVENTION

1. Field of the Invention

The present invention relates to a warp sheet arranging device for arranging and moving a warp sheet to the bottom side of a reed and a reed control device for maintaining and inspecting the reed while being interlocked with the warp sheet arranging device, wherein both the devices are used in a shuttleless loom.

2. Prior Art

Conventional devices of this type are disclosed in Japanese Patent Publication No. 61-32416 and No. 61-56340, in which the devices are moved in the width direction of the warps while brushes are turned in the groove of the reed.

The conventional devices are used before the reed is incorporated in a loom, or before weaving if the reed is incorporated into the loom. Accordingly, the conventional devices cannot be used in a loom undergoing weaving because of the presence of the warp sheet.

SUMMARY OF THE INVENTION

It is therefore an object of the present invention to move a warp sheet from a space where a reed is maintained and inspected to the bottom side of the reed in order to control and maintain the reed.

To achieve the above object, the warp sheet arranging device is provided in a shuttleless loom having warps present. The warp sheet arranging device includes a warp sheet arranging bar which is disposed over the warp sheet between shedding frames and which is a cloth fell and vertically movable by a vertical driving means. The warp sheet arranging bar is lowered when the reed is maintained and inspected, thereby moving the warps to the bottom side of the reed.

If the length of the arranging bar equal to the weaving width of the warp sheet, the arranging bar is disposed so as to not move in the width direction of the warp sheet. However, if the length of the arranging bar is shorter than the width of the warp sheet, the arranging bar is disposed so as to move in the width direction of the warp sheet by an appropriate feeding means. The warp sheet arranging device may be provided at every loom, or may be provided commonly to groups of looms by being movable on a circulating rail attached to a ceiling of a mill.

A reed control device comprises the warp sheet arranging device and a reed maintenance and inspection device composed of a sensor for inspecting soiling or deformation of the reed and a reed maintainer or maintenance device for cleaning the soil or mending or grinding the deformation of the reed upon reception of a signal issued by the sensor. The reed maintenance and inspection device is provided at every loom, or commonly to the groups of looms by being movable on the circulating rail attached to the ceiling of the mill.

In a shuttleless loom having warps present according to the present invention, since the warp sheet arranging bar is provided between the shedding frames and cloth fell, the warp sheet can be moved to the bottom side of the reed when the reed is maintained and inspected, whereby the sensor for detecting the condition of the reed or the device for cleaning and mending the reed is neither obstructed by the warp sheet nor contacts the warps. As a result, fluff is not generated, the operation can be made with ease and weaving trouble after completion of the maintenance and inspection of the reed is reduced.

DESCRIPTION OF THE PREFERRED EMBODIMENT

Figure 1:
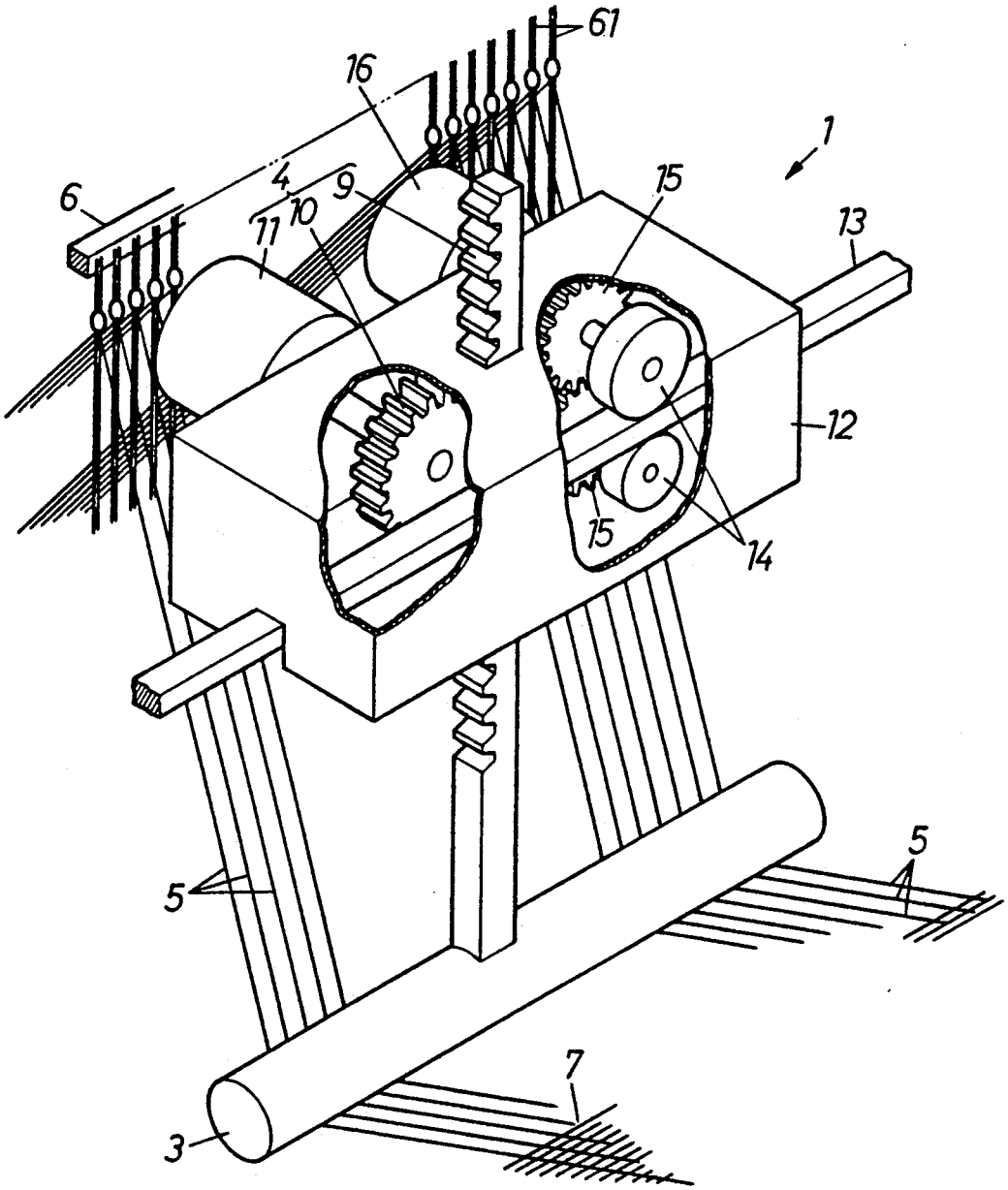
FIG. 1 is a perspective view of a warp sheet arranging device according to a first embodiment of the present invention.
Figure 2:
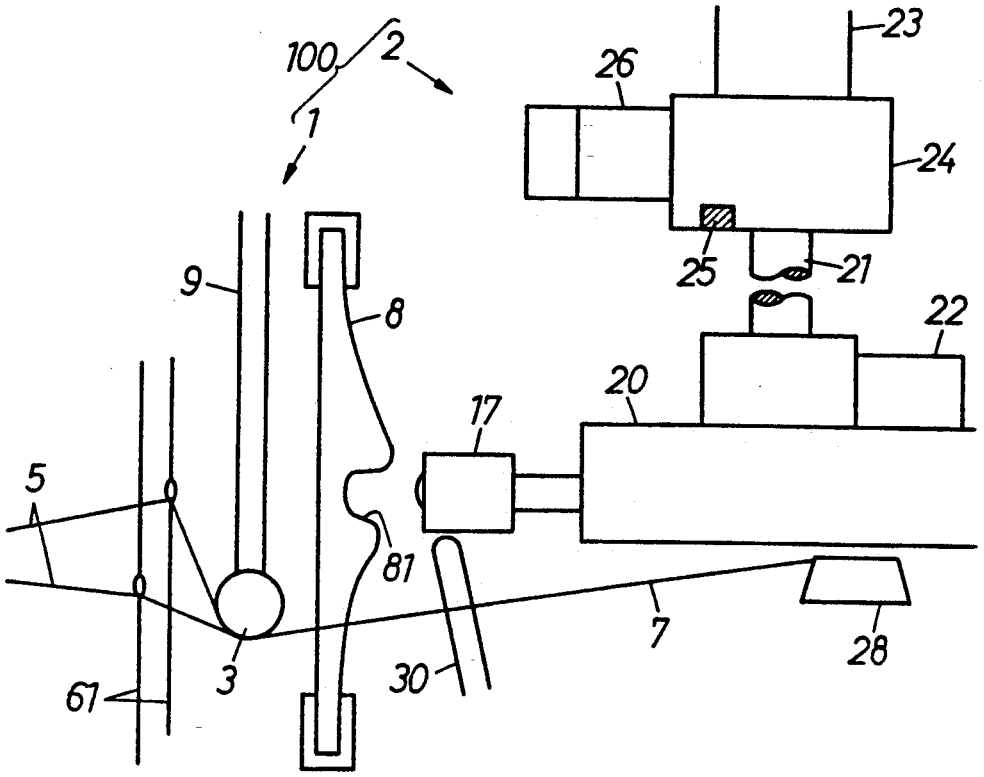
FIG. 2 is a side view showing a state where a sensor of a reed maintenance and inspection device confronts a reed at a state where an arranging bar lowers according to the first embodiment of the present invention.
Figure 3:
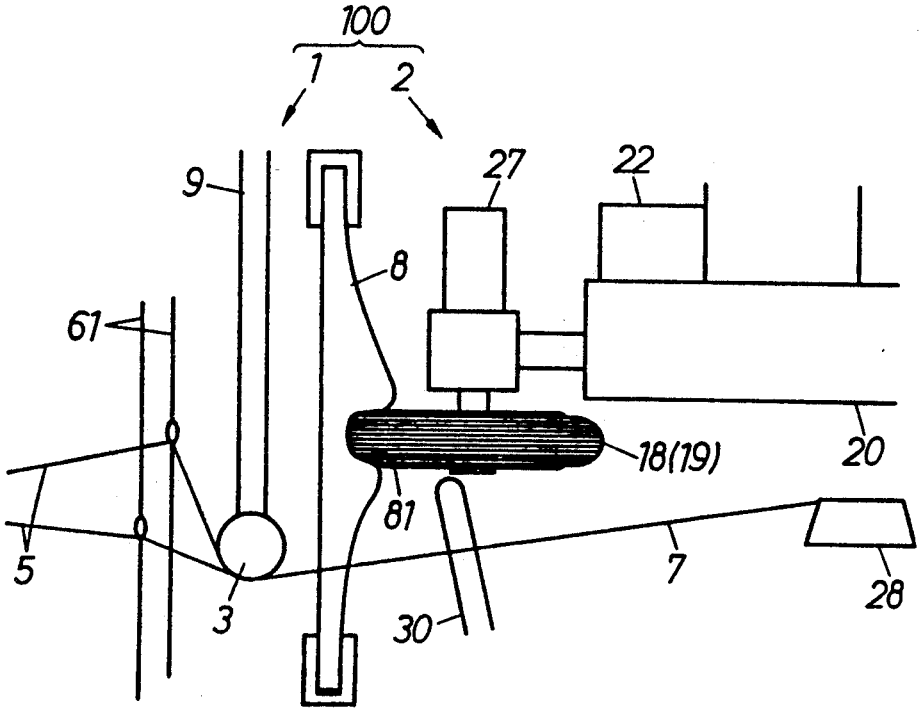
FIG. 3 is a side view showing a state where a cleaning brush, serving as the reed maintenance and inspection device is brought into contact with a groove of the reed at the state where the arranging bar lowers according to the first embodiment of the present invention.

First Embodiment (FIGS. 1 to 3)

FIG. 1 shows an embodiment of a shuttleless loom incorporating therein a warp sheet arranging device.

A shuttleless loom incorporates therein a reed control device 100 composed of a warp sheet arranging device 1 and a reed maintenance inspection device 2 as illustrated in FIGS. 2 to 3.

The warp sheet arranging device 1 comprises a horizontal arranging bar 3 and a vertical driving device 4 for vertically arranging the horizontal arranging bar 3. If the length of the arranging bar 3 is longer than the width of a warp sheet 5, the arranging bar 3 is provided between a shedding frame 6 and a cloth fell 7 so as to be vertically movable for moving the warp sheet 5 to the bottom side of a reed 8.

The vertical driving device 4 comprises a vertically directed rack 9, a pinion 10 meshing with the rack 9 and a motor 11 for driving the pinion 10, and is attached to an inner portion or an outer portion of a movable frame 12. If the length of the horizontal arranging bar 3 is shorter than the width of the warp sheet 5, the movable frame 12 can be moved in the width direction of the warp sheet 5 by a feeding device along a horizontal rail 13 over the warp sheet 5. The feeding device comprises a pair of driving rollers 14, gears 15 for driving the pair of driving rollers 14 and a feed motor 16.

The reed maintenance and inspection device 2 comprises a sensor 17 for inspecting the reed and a cleaning brush 19 serving as a reed maintenance device 18. These components of the reed maintenance and inspection device 2 are fixed to opposite ends of a rotary arm 20 and disposed in confronting relation with a groove 81 of the reed 8. The rotary arm 20 is fixed against the rotation to a rod 21 of a vertically movable cylinder 23. A dividing driving portion 22 is fixed to the rotary arm 20 and turns the arm 20 at every rotary angle of 180°.

The cylinder 23 is disposed to be movable in the weaving width direction, for each loom, by an exclusive movable frame 24, a guide rail 25 and a feed motor 26.

During a picking operation, when picking resistance is increased, partially due to soil and deformation of the reed 8 (the soil sticks to and collects in the groove of a reed dent, and the reed dent is formed by the reed hitting something, hereinafter referred to as an undesirable portion of the reed 8), there occurs a failure of picking. In this state, a weft stopping device, not shown, automatically stops the loom. A feed control device, not shown, rotates the feed motor 16 so that the warp sheet arranging device 1 is moved from a standby position to a predetermined pressing position for pressing the warp sheet 5. Thereafter, the motor 11 is rotated to thereby lower the rack 9 with the pinion 10 while the arranging bar 3 is brought into contact with the upper surface of the warp sheet 5, whereby the arranging bar 3 is moved to the bottom side of the reed 8. The arranging bar 3 is moved after the tension applied to the warp sheet 5 is loosened, at a non-shedding stage, if need be. As a result, the warp sheet 5 is located below the groove of the reed 8.

The feed control device, not shown, drives the feed motor 26 and moves the sensor 17 within the width of the pressed warp sheet 5 in the weaving width direction while it confronts the groove 81 of the reed 8, whereby it optically and electromagnetically detects at every moving position at least one of the thickness of each reed dent, the space between two reed dents, the distance between the reed dent and the sensor 17 and the reflectance, and thereafter generates electric signals. A signal analysis device detects an anomalous signal by comparing the electric signal with a predetermined threshold value, or specifies the position where an anomalous signal is issued as an anomalous position, assuming that a signal representing a differential value is defined as an anomalous signal among the input electric signals.

A control device, not shown, rotates the rotary arm 20 at the rotary angle of 180° using the dividing driving portion 22 and brings the cleaning brush 19 into contact with the groove 81 of the reed 8 at the portion corresponding to the undesirable portion of the reed 8, to thereby clean such undesirable portion with a rotating motor 27. At this time, the cleaning brush 19 does not contact an auxiliary nozzle 30. When these operations are completed in the entire weaving width direction of the warp sheet 5, the reed maintenance and inspection device 2 is set to a standby state and is then returned to its original position. Likewise, the warp arranging device 1 returns the warp sheet 5 to its original state and comes back to the standby position. If the arranging bar 3 is set to be longer than the width of the warp sheet 5, the warp sheet arranging device 1 is structured not to move in the weaving width direction of the warp sheet 5 and is fixedly attached to the portion over the looms.

Figure 4:
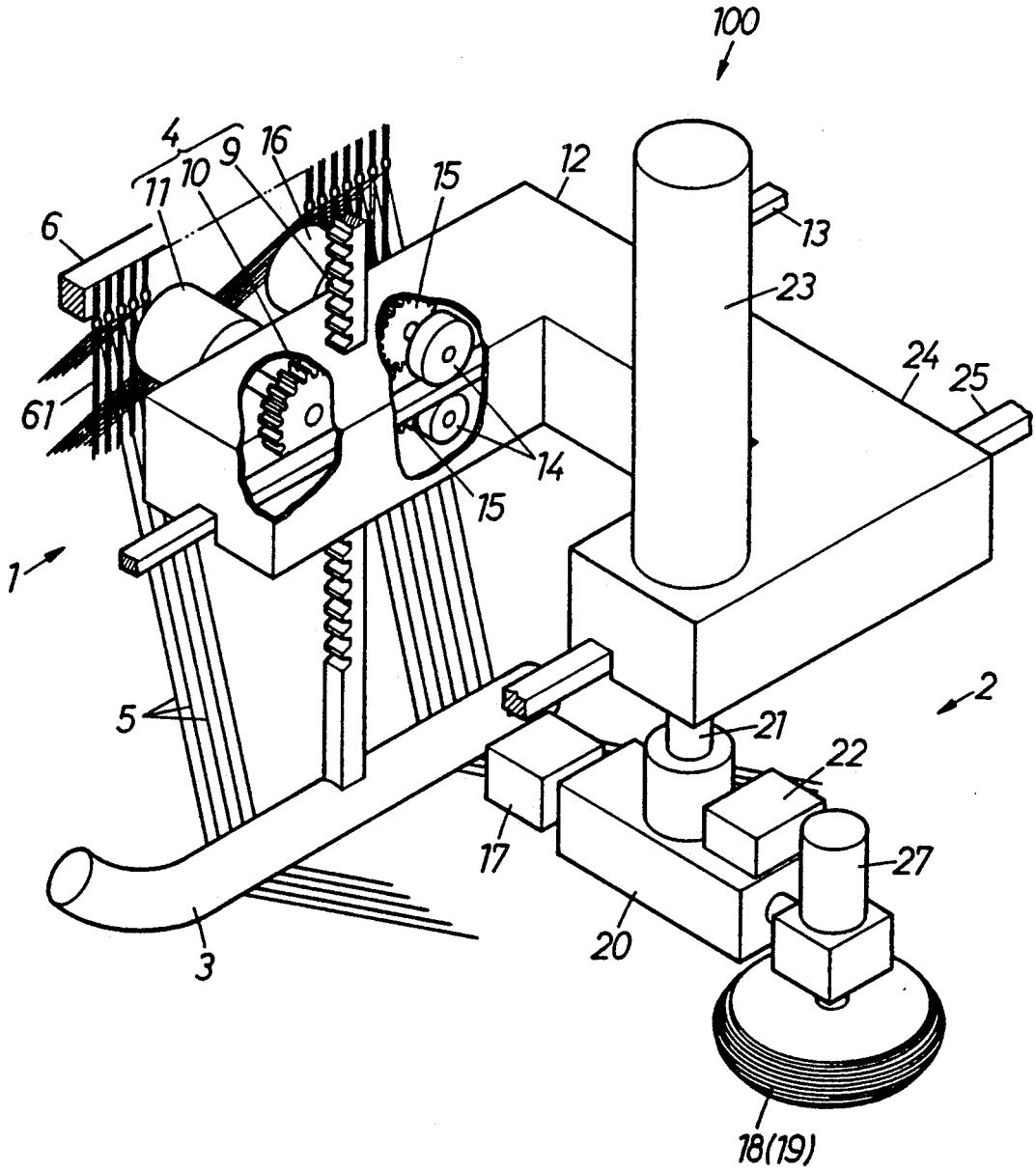
FIG. 4 is a perspective view showing a reed control device composed of a warp sheet arranging device incorporating a reed maintenance and inspection device according to a second embodiment of the present invention.
Figure 5:
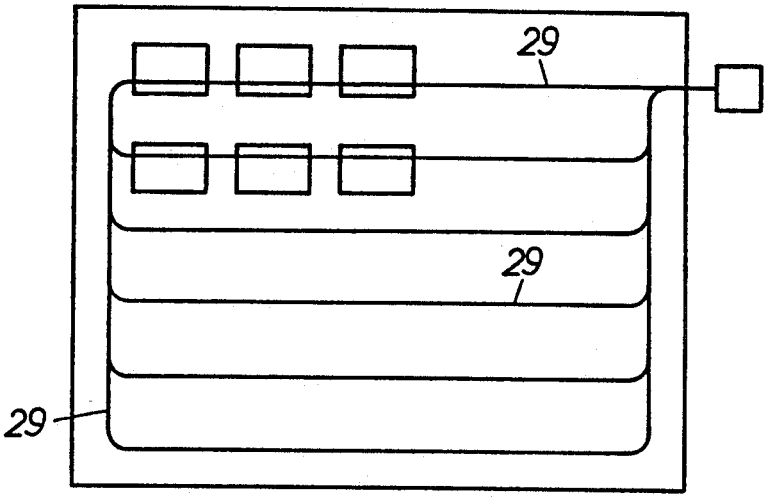
FIG. 5 is a plan view showing a state where the device in FIG. 4 is movable over a plurality of looms along a circulating rail.
Figure 6:
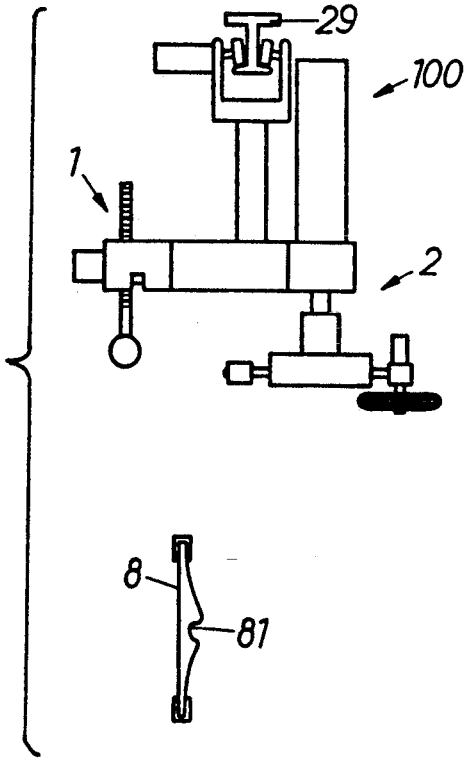
FIG. 6 is a front view showing a state where the warp sheet arranging device and the reed maintenance and inspection device are supported by the circulating rail.

Second Embodiment (FIGS. 4 to 6)

A movable frame 24 may be incorporated with the movable frame 12 and movable by the feed motor 16, whereby the feed motor 26 can be eliminated. When incorporating the movable frame 24 with the movable frame 12, the arranging bar 3 presses the warp sheet 5 in the downward direction while moving in the weaving width direction of the warp sheet 5. An arched guide portion is defined at the tip end of the bar in the moving direction.

A warp sheet arranging device 1 and a reed maintenance and inspection device 2 are installed for every loom according to first embodiment. However, they may be installed singly for each mill. In this case, they may be moved over every loom along a circulating rail 29 shown in FIG. 5. They, i.e. the warp sheet arranging device 1 and the reed maintenance and inspection device 2, are incorporated with each other and are suspended from the circulating rail 29 in a balanced state by a suspending system shown in FIG. 6. The incorporated warp sheet arranging device 1 incorporated with the reed maintenance and inspection device 2 moves automatically to a position based on an instruction to stop at a predetermined loom issued by a concentration maintenance inspection device, and performs the cleaning operation at the position. The warp sheet arranging device 1 may be structured to be provided on the frame which suspends the circulating rail 29 and to be movable vertically alone, without moving in the weaving width direction of the warp sheet 5, while the reed maintenance and inspection device 2 may be structured to be movable both in the weaving width direction and the vertical direction of the warp sheet 5.

The reed maintenance device 18 comprises the cleaning brush 19, but may comprise an air current detector for detecting the air current which flows inside the groove 81 of the reed 8 to thereby detect and undesirable portion of the reed based on air current distribution, or a grinder for grinding an inner surface of the groove 81 of the reed 8 in order to mend an undesirable portion of the reed.

What is claimed is:

1. A warp sheet arranging device in a shuttleless loom having warps thereon forming a warp sheet having a length direction and a width direction, comprising:

a cloth fell;

a shedding frame;

a reed having a groove;

an arranging bar extending in the width direction of the warp sheet, positioned above the warp sheet and between said shedding frame and said cloth fell; and a vertical driving means for moving said arranging bar downward from above the warp sheet to a point lower than said groove of said reed.

2. The warp sheet arranging device of claim 1, and further comprising horizontal means for moving said vertical driving means and said arranging bar in the width direction of the warp sheet.

3. The warp sheet arranging device of claim 2, wherein said horizontal means comprises a horizontal rail having a movable frame movably mounted thereon by a pair of driving rollers, gears connected to said driving rollers and a motor connected to said gears.

4. The warp sheet arranging device of claim 3, wherein said vertical driving means comprises a rack connected to said arranging bar, a pinion engaged with said rack and a motor driving said pinion.

5. The warp sheet arranging device of claim 1, wherein said vertical driving means comprises a rack connected to said arranging bar, a pinion engaged with said rack and a motor driving said pinion.

6. The warp sheet arranging device of claim 1, wherein said arranging bar has an upwardly curved end extending in the width direction of the warp sheet.

7. A reed control device in a shuttleless loom having warps thereon forming a warp sheet, comprising:

a cloth fell;

a shedding frame;

a reed;

a reed maintenance and inspection device, comprising a reed inspection sensor, a reed maintainer, and means for moving said reed inspection sensor vertically and in the width direction of the warp sheet to a position facing said reed for inspection of the reed and for moving said reed maintainer vertically and in the width direction of the warp sheet to a position facing said reed for maintenance thereof; and a warp sheet arranging device comprising an arranging bar and a vertical driving means for vertically moving said arranging bar over the warp sheet between said shedding frame and said cloth fell and lowering the warp sheet relative to said reed.

8. The reed control device of claim 7, wherein said reed maintainer is rotatably mounted and driven by a motor.

9. The reed control device of claim 7, wherein said reed maintenance and inspection device and said vertical driving means for said arranging device are mounted on a common frame, said common frame being disposed on a horizontal rail for movement in the width direction of the warp sheet.

10. The reed control device of claim 7, wherein said reed maintenance and inspection device further comprises a bar having said reed inspection sensor mounted on one end thereof and said reed maintainer on the other end thereof and a motor for rotating said bar in a horizontal plane to switch positions between said reed inspection sensor and said reed maintainer.

11. The reed control device of claim 7, wherein said means for moving of said reed maintenance and inspection device comprises a vertically directed piston and cylinder device mounted on a frame that is movably mounted on a horizontal rail for movement in the width direction of the warp sheet.

12. The reed control device of claim 7, wherein said warp sheet arranging device has means for moving said warp sheet arranging device in the width direction of the warp sheet, and wherein both said warp sheet arranging device and said reed maintenance and inspection device are adapted to be attached to said shuttleless loom.

13. The reed control device of claim 7, further comprising a rail wherein said reed maintenance and inspection device and said warp sheet arranging device are interconnected and movably mounted on said rail for movement to and from said shuttleless loom.

* * * * *